US006654723B1

(12) United States Patent
Oomen et al.

(10) Patent No.: US 6,654,723 B1
(45) Date of Patent: Nov. 25, 2003

(54) TRANSMISSION SYSTEM WITH IMPROVED ENCODER AND DECODER THAT PREVENTS MULTIPLE REPRESENTATIONS OF SIGNAL COMPONENTS FROM OCCURRING

(75) Inventors: Arnoldus Werner Johannes Oomen, Eindhoven (NL); Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 376 days.

(21) Appl. No.: 09/830,377

(22) PCT Filed: Aug. 24, 2000

(86) PCT No.: PCT/EP00/08273

§ 371 (c)(1),
(2), (4) Date: Apr. 25, 2001

(87) PCT Pub. No.: WO01/16941

PCT Pub. Date: Mar. 8, 2001

(30) Foreign Application Priority Data

Aug. 27, 1999 (EP) ..... 99202785

(51) Int. Cl.[7] ..... G10L 19/02
(52) U.S. Cl. ..... 704/500; 704/200.1

(58) Field of Search ..... 704/200.1, 500

(56) References Cited

U.S. PATENT DOCUMENTS 5,886,276 A * 3/1999 Levine et al. ..... 84/603
5,901,234 A * 5/1999 Sonohara et al. ..... 381/104
5,974,376 A * 10/1999 Hassan et al. ..... 704/220
6,460,153 B1 * 10/2002 Chou et al. ..... 714/746

FOREIGN PATENT DOCUMENTS

EP 0 869 622 A2 * 10/1998 ..... H04B/1/66
EP 0 890 943 A2 * 1/1999 ..... G10L/9/14

* cited by examiner

*Primary Examiner*—Tālivaldis Ivars Šmits

(57) ABSTRACT

In a sinusoidal audio encoder it is known to use different time scales for analyzing different parts of the frequency spectrum. In prior art encoders sub-band filtering is used to split the input signal into a number of sub bands. By splitting the input signal into sub-bands, it can happen that a signal component at the boundary of two sub-bands results in a representation in both sub-band signals. This double representation of signal components can lead to several problems when coding these components. According to the present invention it is proposed to use preventing means (46, 48, 58, 68; 88, 92, 96) to avoid signal components to have multiple representations.

15 Claims, 4 Drawing Sheets

TRANSMISSION SYSTEM WITH IMPROVED ENCODER AND DECODER THAT PREVENTS MULTIPLE REPRESENTATIONS OF SIGNAL COMPONENTS FROM OCCURRING

FIELD OF THE INVENTION

The present invention relates to a transmission system comprising a transmitter having an audio encoder, said audio encoder comprising segmenting means for deriving at least first signal segments and second signal segments from an input signal representing an audio signal, the first signal segments being longer than the second signal segments, the audio encoder comprising means for deriving an encoded audio signal from said first and second signal segments, the transmitter comprising transmit means for transmitting the encoded audio signal to a receiver via a transmission medium, the receiver comprising receive means for receiving the encoded audio signal from the transmission medium, the receiver further comprising an audio decoder for deriving a decoded audio signal from the encoded audio signal.

The present invention is also related to a transmitter, an encoder, an encoding method, a tangible medium carrying a computer program for performing an encoding method, and a signal carrying a computer program for performing an encoding method.

BACKGROUND OF THE INVENTION

A transmission system according to the preamble of claim 1 is known from U.S. Pat. No. 5,886,276.

Such transmission systems and audio encoders are used in applications in which audio signals have to be transmitted over a transmission medium with a limited transmission capacity or have to be stored on storage media with a limited storage capacity. Examples of such applications are the transmission of audio signals over the Internet, the transmission of audio signals from a mobile phone to a base station and vice versa and storage of audio signals on a CD-ROM, in a solid state memory or on a hard disk drive.

Different operating principles of audio encoders have been tried to achieve a good audio quality at a modest bit rate. In one of these operating methods, an audio signal to be transmitted is divided into a plurality of segments, normally having a fixed length of 10–20 ms. In each of said segments the audio signal is represented by a plurality of signal components, which can be sinusoids that are defined by their amplitudes, their frequencies and possibly their phases.

The transmitter transmits a representation of the amplitudes and frequencies of the signal components to the receiver. The operations performed by the transmitter can include channel coding, interleaving and modulation.

The receive means receive a signal representing the audio signal from a transmission channel and performs operations like demodulation, de-interleaving and channel decoding. The decoder obtains the representation of the audio signal from the receive means and derives a reconstructed audio signal from it by generating a plurality of sinusoids as described by the encoded signal and combining them into an output signal.

A problem with these audio encoders is to select a proper length (in units of time) for the signal segments. If the signal segments are long, a good frequency resolution for the determination of the signal components is possible, but, as a result of a limited time resolution, a phenomenon called pre-echo can occur. Pre-echoes occur when an event such as a sudden attack of an audio signal is already audible prior to the actual occurrence of the event. If the signal segments are short no problems with pre echoes occur, but the frequency resolution for the determination of signal components with low frequencies is drastically reduced.

To improve this, in the above US patent, the input signal is split into a number of sub-bands by means of a sub-band filter and for each of the sub-bands a different length of the signal segments is chosen. The length of the signal segments is chosen inversely proportional to the frequency range of the corresponding sub-band.

A problem with this approach is that the encoding quality for signal components located around the transition band of the sub-band filter is less than for other signal components.

An object of the present invention is to provide a transmission system according to the preamble in which the above problem is solved.

BRIEF SUMMARY OF THE INVENTION

To achieve the above object, the transmission system according to the invention is characterized in that the encoding means comprise preventing means for preventing multiple representations of a single signal component to occur in the encoded audio signal.

The present invention is based on the recognition that in the prior art system frequencies in the transition bands of the sub-band filter lead to multiple representations of the same signal components of the input signal. These multiple representations are undesired when a psycho-acoustical model is used to determine the signal components to be transmitted. Furthermore it is difficult to reassemble a signal component which is represented twice in the encoded signal. The multiple representations also lead to a larger bitrate than would be present without multiple representation of a signal component.

By using preventing means to prevent or suppress these multiple representations of a single signal component, the associated problems are also eliminated.

In an embodiment of the present invention, the preventing means comprise synthesis means for deriving a synthetic audio signal from a part of the encoded audio signal representing said first signal segments and subtraction means for deriving the second signal segments by subtracting the synthetic audio signal from a signal representing the input signal. By subtracting a synthetic audio signal representing the first signal segments from a signal representing the audio signal to obtain the second signal segments, it is realized that signal components determined from the first signal segments are removed from said signal representing the audio signal. Consequently, these signal components are not or strongly attenuated present in the second signal segments. In this way a multiple representation of said single signal components is avoided.

In a further embodiment of the invention, the segmentation means are arranged for deriving further signal segments from the input signal, said further signal segments being longer than the first signal segments, the audio encoder being arranged for deriving the encoded audio signal also on basis of the further signal segments, the audio encoder further comprises synthesizing means for deriving a further synthetic signal from a part of the encoded audio signal representing said further signal segments and subtraction means for deriving the first signal segments by subtracting the further synthetic audio signal from a signal representing the input signal. Experiments have shown that it advantageous to use successive segments with at least three different lengths, because the number of periods in a segment may not be too large but also not too small.

In a still further embodiment of the invention, the audio encoder comprises a filter for deriving a filtered signal from the input signal and in that the audio encoder is arranged for deriving the first signal segments from the filtered signal. By filtering the input signal it is possible to remove some signal components from said input signal making the determination of the remaining signal components more reliable. The signal components not present anymore in the first signal segments are present in the second (or further) signal segments where they are determined. Consequently still a complete description of the output signal is obtained.

A still further embodiment of the invention is characterized in that the coding means are arranged for representing amplitudes on a psycho-acoustical relevant scale. The use of a psycho-acoustical relevant scale to represent amplitude results into a more efficient use of the transmission channel, because less symbols are needed to represent a signal with a given dynamic range. Such a psycho-acoustical relevant scale can e.g. be a logarithmic scale.

BRIEF DESCRIPTION OF THE DRAWINGS

The present invention will now be explained with reference to the drawings.

DETAILED DESCRIPTION OF THE INVENTION

Figure 1:
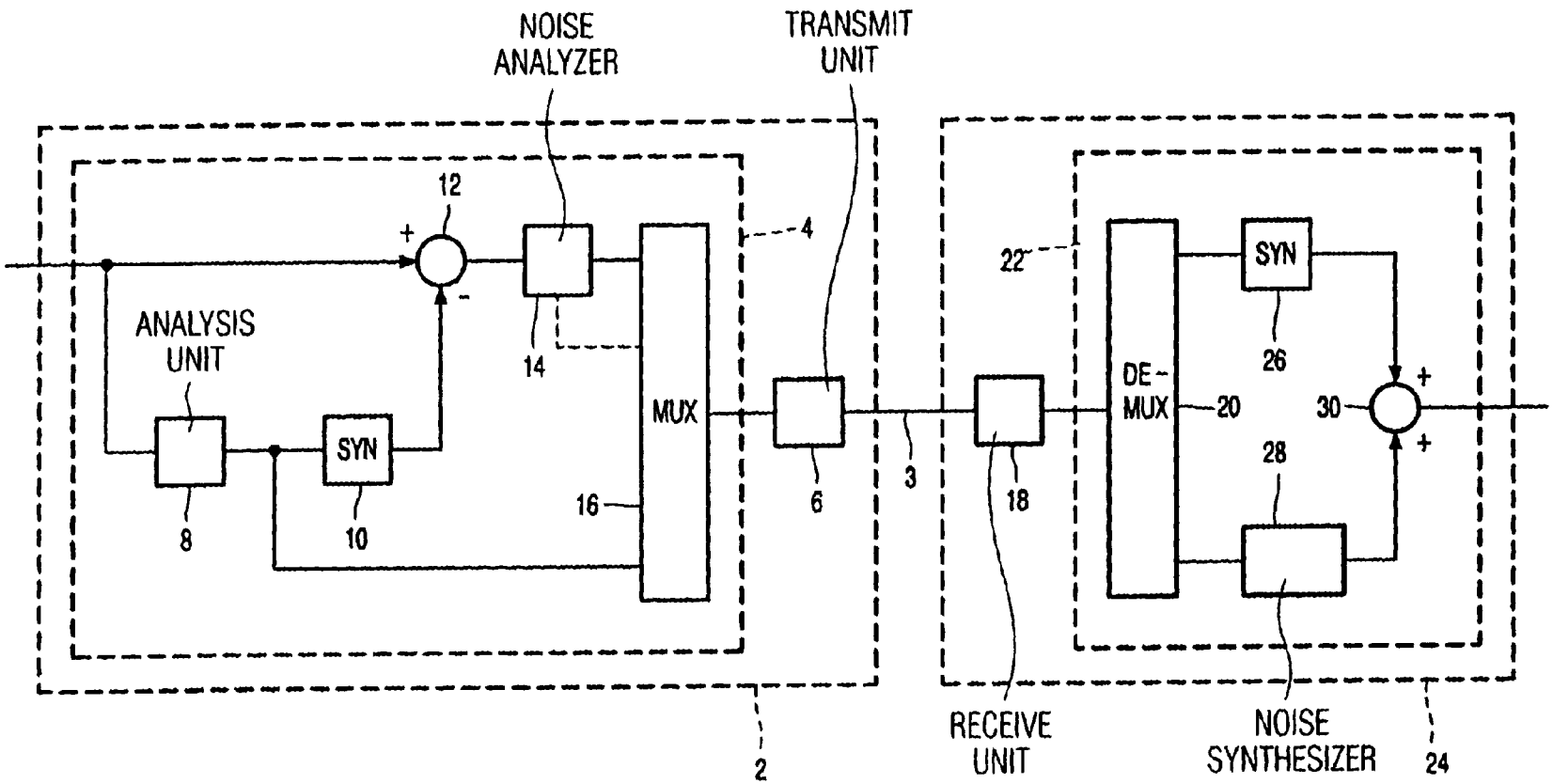
FIG. 1 shows a transmission system in which the present invention can be used.

In the transmission system according to FIG. 1, an audio signal to be transmitted is applied to an input of a transmitter 2. In the transmitter 2, the input signal is applied to an audio encoder 4. In the audio encoder 4, the input signal is applied to a first input of a subtractor 12 and to an input of an analysis unit 8. The analysis unit 8 determines the amplitudes, phases and frequencies of sinusoidal signal components present in its input signal.

An output of the analysis unit 8, carrying an output signal representing the amplitudes, phases and frequencies of the sinusoidal signal components, is connected to an input of a synthesizer 10 and to an input of a multiplexer 16. The synthesizer generates a synthetic audio signal consisting of a plurality of sinusoids on basis of the amplitudes, phases and frequencies received from the analysis unit 8.

An output of the synthesizer 10 carrying the synthetic audio signal is applied to a second input of the subtracter 12. This subtracter 12 subtracts the synthetic audio signal generated by the synthesizer 10 from the input signal.

The output signal of the subtracter 12 is applied to a noise analyzer 14. This noise analyser 14 determines the spectrum of the noise signal at its input. A representation of said noise spectrum is applied to the multiplexer 16. The multiplexer 16 combines the signals from the analyzer 8 and the noise analyzer 14 into a combined signal.

Preferably the multiplexer 16 uses a psycho acoustical model to determine which signal components determined by the analyzer 8 are perceptually relevant. Only these perceptually relevant signal components are transmitted. The use of a psycho acoustical model to determine the perceptually relevant signal components is commonly used in frequency domain encoders and is consequently well known to those skilled in the art.

The output signal of the multiplexer 16 constitutes the output signal of the audio encoder 4. This output of the audio encoder 4 is connected to an input of a transmit unit 6 which generates a signal that is suitable for transmission via the transmission medium 3 to a receiver 24. The transmit unit 6 performs operations like channel coding, interleaving and modulation.

The signal from the transmission medium 3 is applied to a receive unit 18 in a receiver 24. The receive unit 18 performs operations like demodulation, deinterleaving and channel decoding.

The output of the receive unit 18 is connected to an input of an audio decoder 22. In the audio decoder 22, the signal from the receive unit is applied to a demultiplexer 20 which provides a first signal describing the sinusoidal signal components determined by the analyzer 8 and a second signal describing the noise spectrum determined by the analyzer 14.

The first signal is applied to a sinusoidal synthesizer 26 which derives a synthetic signal from the first signal. The synthesizer 26 is similar as the synthesizer 10 used in the encoder 4. The second signal is applied to a noise synthesizer 28 which generates a noise signal with a spectrum defined by the second signal. This can be done by performing an IFFT on the spectrum received in which random phases are assigned to the spectral components. The output signals of the sinusoidal synthesizer 26 and the noise synthesizer 28 are added by an adder 30 to obtain a replica of the input audio signal.

Figure 2:
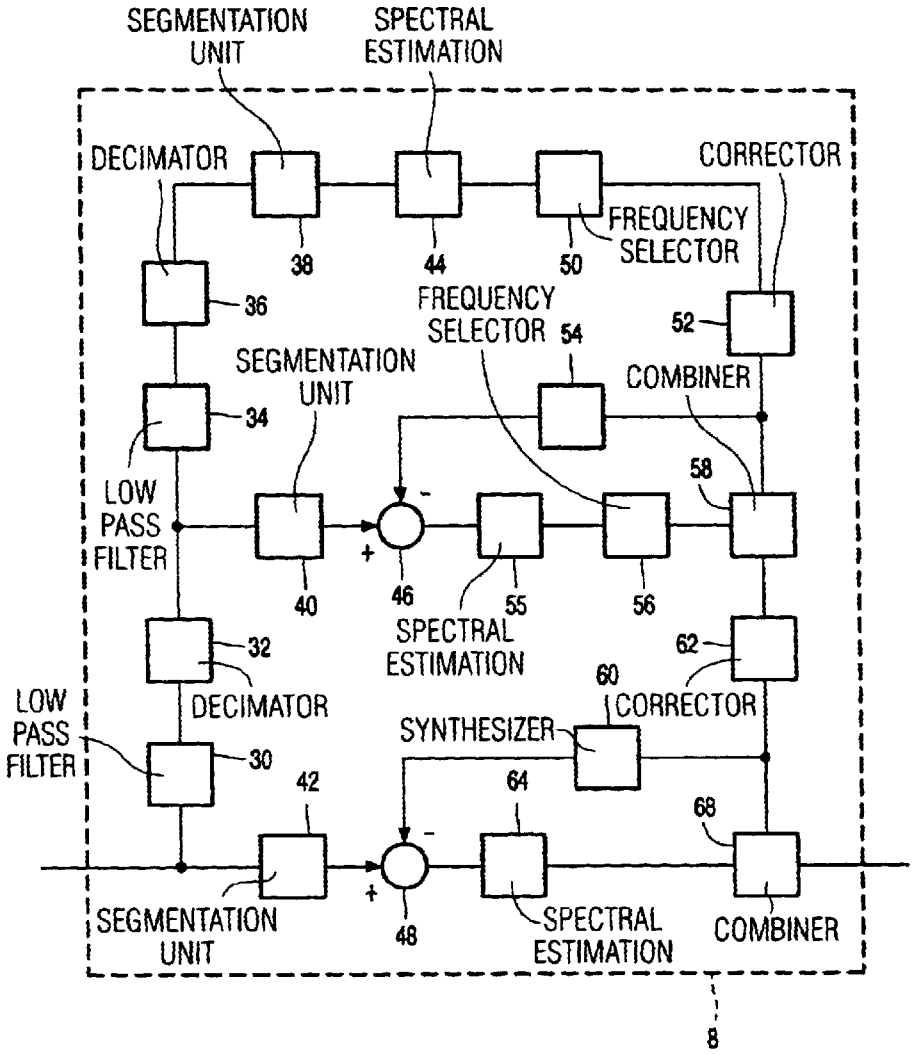
FIG. 2 shows an analysis unit 8 for sinusoids according to the invention to be used in the transmission system according to FIG. 1.

In the analyzer 8 according to FIG. 2, the input signal is applied to a segmentation unit 42 and to an input of a low pass filter 30. The segmentation unit 42 selects segments comprising 360 samples from the input signal. With a sampling rate of 44.1 kHz of the input signal, this corresponds to an analysis period of 8.16 ms.

The output of the low pass filter 30 is connected to an input of a decimator 32 which reduces the sample rate by a factor of 3. The low pass filter 30 provides anti-aliasing and has a cut off frequency of 500 Hz. This cut off frequency is substantially lower than would be needed for anti-aliasing, but it has been designed to pass only signals having a low number of periods in the corresponding analysis window almost unattenuated.

The output signal of the decimator 32 is connected to an input of a segmentation unit 40 and to an input of a low pass filter 34. The segmentation unit 40 selects segments comprising 360 samples from the output signal of the decimator 32. With a (reduced) sampling rate of 14.7 kHz, this corresponds to an analysis period of 24.5 ms.

The low pass filter 34 has a cut off frequency of 165 Hz. The output of the low pass filter 34 is connected to an input of a decimator 36, which again reduces the sample rate, by a factor of 3. The output of the decimator 36 is connected to an input of a segmentation unit 38, which selects segments comprising 256 samples. With a (twice-reduced) sample rate of 4.9 kHz, this corresponds to an analysis period of 52.2 ms.

The output signal of the segmentation unit 38 is applied to a spectral estimation unit 44, which determines spectral components by peak picking and a subsequent fine search in the Fourier domain. Several methods of estimation of sinusoidal components are well known to those skilled in the art of audio coding.

The output of the spectral estimation unit 44 is connected to an input of a frequency selector 50. This frequency selector selects only the frequency components in a well defined range. In the present example, the selector 50 only selects frequency components with a maximum frequency of 133 Hz. Spectral components with higher frequencies are simply discarded. A corrector 52 corrects the amplitude and phase values of the selected signal components. This correction is needed to compensate the amplitude and phase distortion introduced by the filter 34. Because the transfer function of this filter is known, the needed correction factor can be easily determined.

The output of the corrector 52 is applied to a synthesizer 54, which generates a synthetic speech signal on basis of the output signal of the corrector 52. The sample rate of the synthetic audio signal provided by the synthesizer 54 corresponds to the sample rate at the output of the decimator 32. The synthetic audio signal provided by the synthesizer 54 is subtracted from the output signal of the segmentation unit 40 by means of a subtractor 46. The combination of the synthesizer 54 and the subtracter 46 is part of the preventing means according to the invention. Consequently, the signal components determined by the estimation unit 44 and selected by the selection unit 50 are substantially removed from the output signal of the segmentation means 40.

The output signal of the subtractor 46 is passed to a spectral estimation unit 55 that determines the spectral components in said output signal. Subsequently, a selection unit selects only the signal components having a frequency below 400 Hz.

The outputs of the corrector 52 and the selector 56 are connected to inputs of a combiner 58. The combiner 58 combines frequency estimates derived from signal segments with different durations. Since at a finer timescale (short segments) the nearly same frequency can be found as on coarser time scales, the corresponding signal components can be represented by a single signal component. In the present example this combining will take place when the frequencies differ less than $10^{-3}$ rad. The combiner 58 is also a part of the preventing means.

The output of the combiner 58 is passed to a corrector 62 to correct for the amplitude and phase distortion of the filter 30. The output signal of the corrector 62 is applied to an input of a synthesizer 60 which generates a synthetic audio signal on basis of the identified signal components. The synthetic audio signal generated by the synthesizer 60 is subtracted from the output signal of the segmentation unit 42 by a subtracter 48. The combination of the synthesizer 60 and the subtracter 48 is part of the preventing means according to the invention. The output signal of the subtracter 48 is passed to a spectral estimation unit 64, which determined signal components in its input signal. These signal components are passed together with the output signal of the corrector 62 to a combiner 68 which determines a representation of all sinusoids found in the input signal. The maximum number of sinusoids to be determined by the estimator 44 is chosen equal to 5, the maximum number of sinusoids to be determined by the analyzer 44 and 55 together is 10 and the total number of sinusoids determined by the analyzers 44, 55 and 64 have been chosen equal to 60.

As the output signals of the segmentation units 38, 40 and 42 have different lengths, the analysis is also performed on different time scales. The preventing means to suppress or prevent multiple representations of a single signal component are here the synthesizers 54 and 60, the subtracters 46 and 48 and the combiners 58 and 68. It is however conceivable that only the combination of synthesizers and subtracters are used in the preventing means, or that only the combiners are used in the preventing means.

Figure 3:
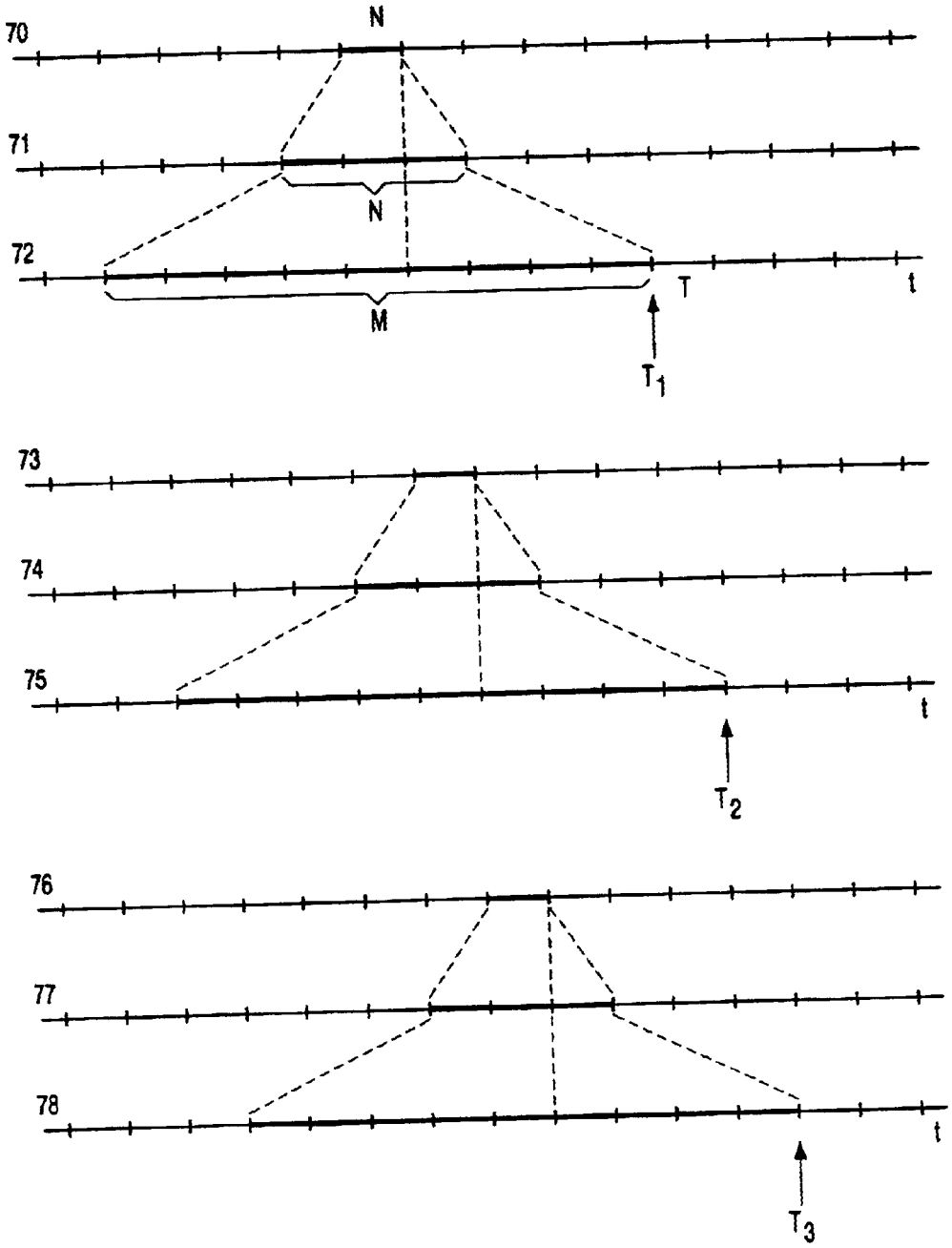
FIG. 3 shows the signal segments used in the analysis unit 8 according to FIG. 2.

In the diagrams according to FIG. 3, the signal segments as used in the analyzer 8 are displayed. Graphs 70, 71 and 72 show the involved signal segments at instance $T_1$.

Graph 70 shows a segment that is available at the output of the segmentation unit 42 at instant $T_1$. The segment comprises N=360 samples. Graph 71 shows the segment that is available at the output of segmentation unit 40 at instant $T_1$. This segment also comprises N=360 samples.

Graph 72 shows a segment that is available at the output of segmentation unit 38 at instance $T_1$. The segment comprises now M=256 samples. From these graphs it is clear that signal segments of different duration are used in the analysis.

Graphs 73, 74 and 75 show the signal segments at a subsequent analysis instant $T_2$. It can be seen that all segments are shifted over the duration of the shortest segment to the right. This is because the complete analysis takes place with a period T. Graphs 76, 77 and 78 show the signal segments at an instant $T_3$, being T later than $T_2$.

Figure 4:
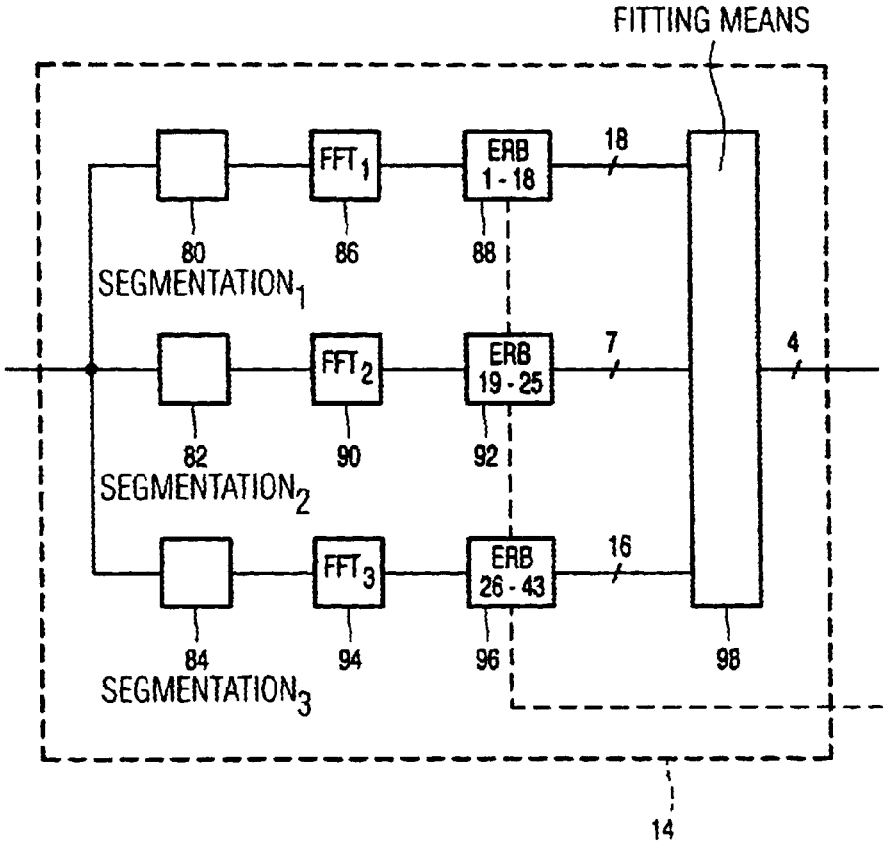
FIG. 4 shows a noise analyzer 14 according to the invention to be used in the transmission system according to FIG. 1.

In the noise analyzer 14 according to FIG. 4 the input signal is applied to an input of segmentation means 80, 82 and 84. The segmentation means 80 are arranged for deriving segments of 1024 samples from the input signal. The segmentation means 82 are arranged for deriving segments of 512 samples from the input signal and the segmentation means 84 are arranged for deriving signal segments of 256 signal samples from the input signal.

The output of the segmentation means 80 is connected to an input of an FFT processor 86 to determine the frequency spectrum for the lower frequency range. The FFT processor 86 is arranged for performing a 1024 point FFT. The output of the segmentation means 82 is connected to an input of an FFT processor 90. This FFT processor 90 performs a 512 point FFT. The output of the segmentation means 84 is connected to an input of an FFT processor 94. The FFT processor 94 performs a 256 points FFT.

In order to apply a psycho acoustical model in the multiplexer 16 in FIG. 1, it is desirable to represent the noise spectrum as noise power per ERB bin. To do so, the values in the FFT bins determined by the FFT processors 86, 90 and 94 are transformed by ERB transformers 88, 92 and 96 into respectively 18, 7 and 18 ERB bins. Because all ERB bins cover different frequency ranges, the ERB transformers 88, 92 and 96 constitute the suppression means for preventing multiple representation of a signal component. It is observed that it is conceivable that the FFT processors 86, 90 and 94 do not perform a complete FFT but only a partial FFT which only determines the frequency bins needed for determining the ERB bins corresponding to said FFT. In that case the suppression means also include the FFT processors 86, 90 and 94.

The ERB transformers 88, 92 and 96 derive the value for each ERB bin by adding the powers in the FFT bins lying in a range defined by said ERB. The transformation to be performed by the ERB transformer can be written in matrix form according to:

$$Y(n)=W(n)\cdot P \tag{1}$$

In (1) Y(n) is the power in each ERB bin in which n represents the rank number of the ERB bin. P is a vector containing as elements the power in the FFT bins, which can be defined as:

$$P = [|X(0)|^2, |X(1)|^2, \ldots, |X(L-1)|^2]^T \quad (2)$$

In (2) $|X(k)|^2$ is the power in the $k^{th}$ FFT bin. L is the number of points included in the FFT. The vector W(n) represents the overlap between the ERB bin and the FFT bin. If $f_1$ represents the lower limit of an ERB bin and $f_2$ represents the upper frequency of said ERB bin, the following can be written for the vector elements W(n,k):

$$W(n, k) = \min\left[\frac{\min[f_2(n), (k+0.5)b] - \max[f_1(n), (k-0.5)b]}{b}, 0\right] \quad (3)$$

In (3), b is the FFT bin size, which is equal to $f_s/L$. Taking different values for n for obtaining all ERB bins leads to a matrix multiplication according to:

$$Y = W \cdot P \quad (4)$$

The power in the ERB bins is passed to an additional output of the noise analyzer 14 for use by the psycho-acoustical model used in the multiplexer 16.

The noise synthesizer 28 needs an inverse transformation $\tilde{W}$ of W in order to obtain FFT bins from ERB bins. This inverse $\tilde{W}$ can be obtained in the same way as W is determined. This inverse $\tilde{W}$ can be calculated according to:

$$\tilde{W}(n, k) = \min\left[\frac{\min[(n+0.5)b, f_2(k)] - \max[(n-0.5)b, f_1(k)]}{f_2(k) - f_1(k)}, 0\right] \quad (5)$$

The 43 ERB power values are passed to fitting means 98 which perform a fit of a third order polynomial to the 43 ERB power values. Therefore the estimated powers are aligned in time (they are estimated in different analysis segment sizes). This fitting procedure results in a reduction of the data from 43 coefficients to 4 coefficients. Before performing the fit, the amplitude in the ERB bins are transformed into values on a psycho-acoustic relevant scale, such as a logarithmic scale or approximations thereof.

In the synthesizer 28 the 43 ERB power values are calculated according to the third order polynomial defined by the 4 coefficients. The synthesis takes place at different time scales for different group of ERB powers just like was done in the analysis.

Whilst the invention has been described with reference to preferred embodiments thereof, it is to be understood that these are not limitative examples. Thus, various modifications may become apparent to those skilled in the art, without departing from the scope of the invention, as defined by the claims.

As an example, it is possible that subsequent signal segments partly overlap although in the embodiments, they are not overlapping. Furthermore, the different preventing means as disclosed in the embodiments need not to be present in combination but can also be used separately.

In summary, a sinusoidal audio encoder it is known to use different time scales for analyzing different parts of the frequency spectrum. In prior art encoders sub-band filtering is used to split the input signal into a number of sub bands.

By splitting the input signal into sub-bands, it can happen that a signal component at the boundary of two sub-bands results in a representation in both sub-band signals. This double representation of signal components can lead to several problems when coding these components. According to the present invention it is proposed to use preventing means (46, 48, 58, 68; 88, 92, 96) to avoid signal components to have multiple representations.

What is claimed is:

1. Transmission system comprising a transmitter having an audio encoder, said audio encoder comprising segmenting means for deriving at least first signal segments and second signal segments from an input signal representing an audio signal, the first signal segments being longer than the second signal segments, the audio encoder comprising encoding means for deriving an encoded audio signal from said first and second signal segments, the transmitter comprising transmit means for transmitting the encoded audio signal to a receiver via a transmission medium, the receiver comprising receive means for receiving the encoded audio signal from the transmission medium, the receiver further comprising an audio decoder for deriving a decoded audio signal from the encoded audio signal, characterized in that the encoding means comprise preventing means for preventing multiple representations of a single signal component to occur in the encoded audio signal.

2. Transmission system according to claim 1, characterized in that the preventing means comprise synthesis means for deriving a synthetic audio signal from a part of the encoded audio signal representing said first signal segments and subtraction means for deriving the second signal segments by subtracting the synthetic audio signal from a signal representing the input signal.

3. Transmission system according to claim 2, characterized in that the segmentation means are arranged for deriving further signal segments from the input signal, said further signal segments being longer than the first signal segments, the audio encoder being arranged for deriving the encoded audio signal also on basis of the further signal segments, the preventing means comprising further synthesizes means for deriving a further synthetic signal from a part of the encoded audio signal representing said further signal segments and further subtraction means for deriving the first signal segments by subtracting the further synthetic audio signal from a signal representing the input signal.

4. Transmission system according to claim 1, characterized in that the audio encoder comprises a filter for deriving a filtered signal from the input signal and in that the audio encoder is arranged for deriving the first signal segments from the filtered signal.

5. Transmission system according to claim 4, characterized in that the filter comprises decimation means for obtaining said first signal segments with a reduced sample rate.

6. Transmission system according to claim 1, characterized in that the encoding means are arranged for representing amplitudes on an psycho-acoustical relevant scale.

7. Transmitter having an audio encoder, said audio encoder comprising segmenting means for deriving at least first signal segments and second signal segments from an input signal representing an audio signal, the first signal segments being longer than the second signal segments, the audio encoder comprising encoding means for deriving an encoded audio signal from said first and second signal segments, the transmitter comprising transmit means for transmitting the encoded audio signal, characterized in that the encoding means comprise preventing means for preventing multiple representations of a single signal component to occur in the encoded audio signal.

8. Transmitter according to claim 7, characterized in that the preventing means comprise synthesis means for deriving a synthetic audio signal from a part of the encoded audio signal representing said first signal segments and subtraction means for deriving the second signal segments by subtracting the synthetic audio signal from a signal representing the input signal.

9. Audio encoder comprising segmenting means for deriving at least first signal segments and second signal segments from an input signal representing an audio signal, the first signal segments being longer than the second signal segments, the audio encoder comprising encoding means for deriving an encoded audio signal from said first and second signal segments, characterized in that the encoding means comprise preventing means for preventing multiple representations of a single signal component to occur in the encoded audio signal.

10. Audio encoder according to claim 9, characterized in that the preventing means comprise synthesis means for deriving a synthetic audio signal from a part of the encoded audio signal representing said first signal segments and subtraction means for deriving the second signal segments by subtracting the synthetic audio signal from a signal representing the input signal.

11. Audio encoding method comprising deriving at least first signal segments and second signal segments from an input signal representing an audio signal, the first signal segments being longer than the second signal segments, the method comprising deriving an encoded audio signal from said first and second signal segments, characterized in that the method comprises preventing multiple representations of a single signal component to occur in the encoded audio signal.

12. Method according to claim 11, characterized in that the method comprises deriving a synthetic audio signal from a part of the encoded audio signal representing said first signal segments and deriving the second signal segments by subtracting the synthetic audio signal from a signal representing the input signal.

13. Computer program for enabling a processor to carry out the method according to claim 11.

14. Tangible medium carrying a computer program according to claim 13.

15. Signal carrying a computer program according to claim 13.

* * * * *